US011337583B2

(12) United States Patent
Feddema et al.

(10) Patent No.: US 11,337,583 B2
(45) **Date of Patent: *May 24, 2022**

(54) DISHWASHER WITH A LOW-PROFILE RACK

(71) Applicant: WHIRLPOOL CORPORATION, Benton Harbor, MI (US)

(72) Inventors: Mark S. Feddema, Kalamazoo, MI (US); Ajay Satish Singhal, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/106,925

(22) Filed: Nov. 30, 2020

(65) Prior Publication Data

US 2021/0076900 A1 Mar. 18, 2021

Related U.S. Application Data

(62) Division of application No. 16/220,796, filed on Dec. 14, 2018, now Pat. No. 10,888,212.

(51) Int. Cl.

| | |
|---|---|
| ***A47L 15/50*** | (2006.01) |
| ***A47L 15/23*** | (2006.01) |
| ***A47L 15/42*** | (2006.01) |
| ***A47L 15/48*** | (2006.01) |

(52) U.S. Cl.

CPC ..... *A47L 15/50* (2013.01); *A47L 15/23* (2013.01); *A47L 15/4246* (2013.01); *A47L 15/4272* (2013.01); *A47L 15/48* (2013.01)

(58) Field of Classification Search

CPC ..... A47L 15/50; A47L 15/23; A47L 15/4246; A47L 15/4272; A47L 15/48; A47F 3/147; A47F 5/0031; A47F 5/0056; A47F 5/01

USPC ..... 211/41.1–41.9

See application file for complete search history.

(56) References Cited

U.S. PATENT DOCUMENTS

| | | | |
|---|---|---|---|
| 3,433,363 | A | 3/1969 | Clearman et al. |
| 3,464,566 | A | 9/1969 | Gilson |
| 3,752,322 | A | 8/1973 | Fiocca et al. |
| 4,046,261 | A | 9/1977 | Yake |
| 4,339,051 | A | 7/1982 | Crawford |
| 4,917,248 | A | 4/1990 | Friskney |
| 5,158,185 | A | 10/1992 | Michael et al. |
| 5,205,419 | A | 4/1993 | Purtilo |
| 5,601,195 | A | 2/1997 | Finola et al. |
| 6,571,965 | B1 | 6/2003 | Beck et al. |
| 6,848,585 | B2 | 2/2005 | VanLandingham |
| 7,231,929 | B2 | 6/2007 | Landsiedel et al. |
| 8,408,403 | B2 | 4/2013 | Hedstrom et al. |

(Continued)

FOREIGN PATENT DOCUMENTS

| | | | |
|---|---|---|---|
| EP | 0186157 | A1 | 7/1986 |
| EP | 1138249 | A2 | 10/2001 |
| EP | 2815690 | A1 | 12/2014 |

*Primary Examiner* — Patrick D Hawn

(74) *Attorney, Agent, or Firm* — McGarry Bair PC

(57) ABSTRACT

A dishwasher with a tub that at least partially defines a treating chamber with an access opening, a closure moveable relative to the tub to selectively open and close the access opening, a lower dish holder located within the treating chamber, a middle dish holder located within the treating chamber above the lower dish holder, and an upper dish holder located within the treating chamber above the middle dish holder and having container supports defining a support surface.

15 Claims, 7 Drawing Sheets

(56) References Cited

U.S. PATENT DOCUMENTS

| | | | |
|---|---|---|---|
| 8,646,620 | B2 | 2/2014 | Klump et al. |
| 8,651,287 | B2 | 2/2014 | Moser et al. |
| 9,949,613 | B2 | 4/2018 | Blanchard et al. |
| 10,349,804 | B2 | 7/2019 | Tuller |
| 10,463,226 | B2 | 11/2019 | Mesa et al. |
| 10,512,385 | B2 | 12/2019 | Tuller et al. |
| 10,638,912 | B1 | 5/2020 | Visin et al. |
| 2003/0226580 | A1 | 12/2003 | Welch |
| 2005/0109378 | A1 | 5/2005 | Landsiedel et al. |
| 2006/0250058 | A1 | 11/2006 | Stevens et al. |
| 2006/0254992 | A1 | 11/2006 | Lim |
| 2006/0254994 | A1 | 11/2006 | Lim |
| 2007/0247039 | A1 | 10/2007 | Anderson et al. |
| 2008/0083678 | A1 | 4/2008 | Graute |
| 2009/0120883 | A1 | 5/2009 | Jadhav et al. |
| 2012/0298598 | A1 | 11/2012 | Ennen et al. |
| 2019/0290094 | A1 | 9/2019 | Balinski et al. |

DISHWASHER WITH A LOW-PROFILE RACK

CROSS-REFERENCE TO RELATED APPLICATIONS

This application claims priority to and is a divisional application of U.S. patent application Ser. No. 16/220,796, filed on Dec. 14, 2018, now U.S. Pat. No. 10,888,212, issued Jan. 12, 2021, which is hereby incorporated herein by reference in its entirety.

BACKGROUND

Household dishwashers typically include one or more dish racks for holding various types of dishes in the dishwasher tub. Traditionally, a dishwasher includes an upper rack that holds glassware and small dishes, and a lower rack that holds larger dishes, such as plates. These two dish racks usually consume most of the space inside the dishwasher tub. Some dishwashers can also include a third upper dish rack, often for silverware or other low profile utensils.

BRIEF DESCRIPTION

In one aspect, the disclosure relates to a dish holder for a dishwasher comprising a wire frame racking having a plurality of spaced wire frame elements, with adjacent wire frame elements forming a low profile, sloped support surface, having a lower end and an upper end, with a seat at the lower end, and a wicking element mounted to the wire frame and having at least one wick forming an acute angle to a horizontal reference and overlying at least a portion of the support surface at the seat.

In another aspect, the disclosure relates dish holder comprising a support surface having a lower end and an upper end for a dishwasher. The dish holder has a wicking element located at the lower end and comprising a longitudinal body overlying a portion of the lower end. The dish holder has first and second wicks extending from and fixedly mounted to opposite side of the longitudinal body. The first wick overlays a portion of the support surface to define a seat for engaging a lip edge of glassware such that a first stop of the first wick abuts the lip edge to break a surface tension of a liquid in the glassware.

DETAILED DESCRIPTION

Figure 1:
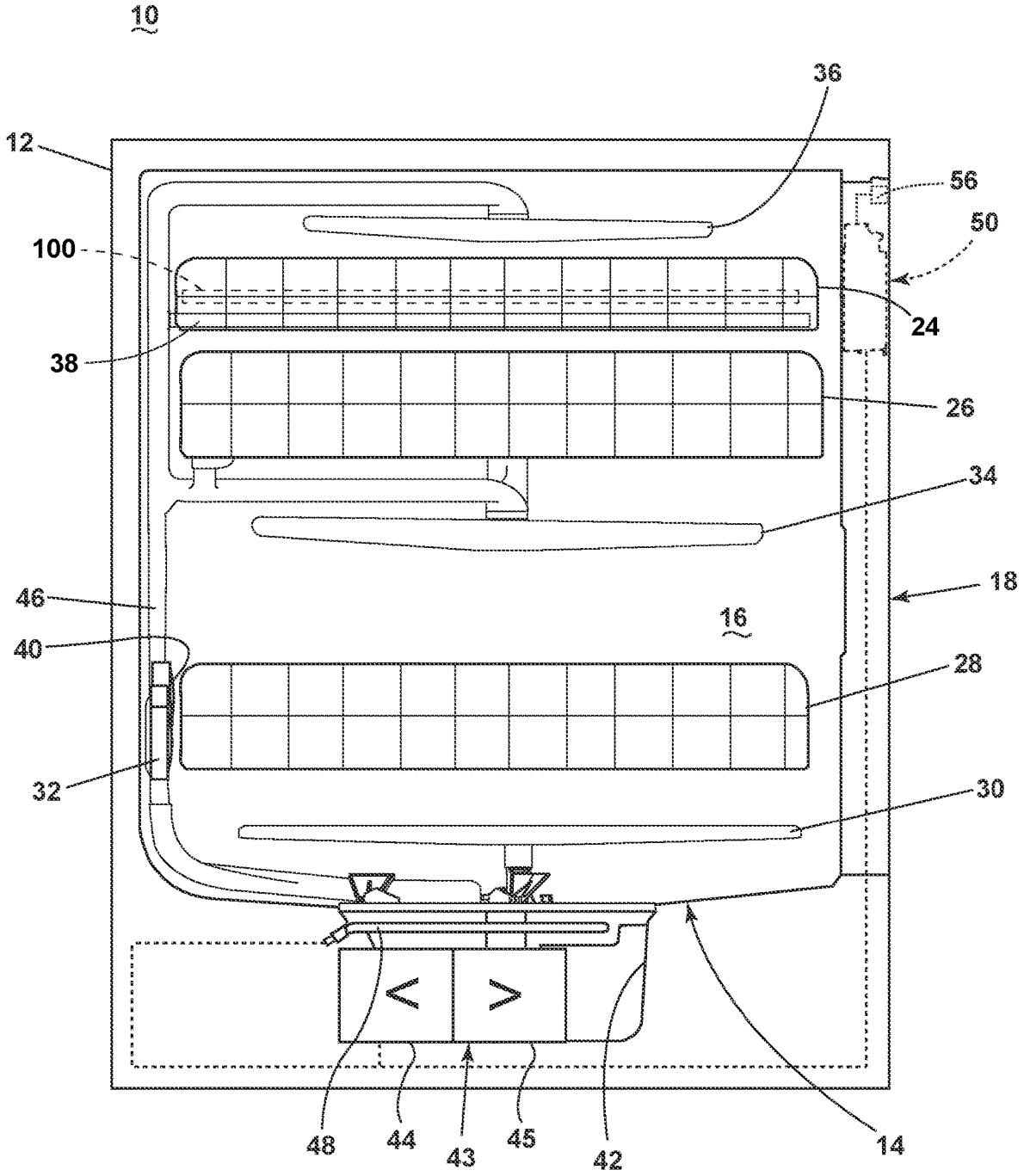
FIG. 1 is a schematic, cross-sectional view of a dishwasher with an upper dish rack having a wicking element according to the description.

In FIG. 1, an automated dishwasher 10 according to an aspect of the present disclosure is illustrated. The dishwasher 10 shares many features of a conventional automated dishwasher, which will not be described in detail herein except as necessary for a complete understanding of the disclosure. A cabinet or chassis 12 can define an interior of the dishwasher 10 and can include a frame, with or without panels mounted to the frame. An open-faced tub 14 can be provided within the chassis 12 and can at least partially define a treating chamber 16, having an open face, for washing dishes. A closure element, such as a door assembly 18, can be movably mounted to the chassis 12 for movement between opened and closed positions to selectively open and close the treating chamber 16 access as defined by the open face of the tub 14. Thus, the door assembly 18 provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open. Alternatively, the closure element can be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the disclosure.

Dish holders, illustrated in the form of upper, middle, and lower dish racks 24, 26, 28, are located within the treating chamber 16 and receive dishes for washing. The upper, middle, and lower racks 24, 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 30, a second lower spray assembly 32, a rotating mid-level spray arm assembly 34, and/or an upper spray arm assembly 36. Upper sprayer 36, mid-level rotatable sprayer 34 and lower rotatable sprayer 30 are located, respectively, above the upper rack 24, beneath the middle rack 26, and beneath the lower rack 28 and are illustrated as rotating spray arms. The spray system can further include a rack spray assembly 38 coupled to the upper dish rack 24. The second lower spray assembly 32 is illustrated as being located adjacent the lower dish rack 28 toward the rear of the treating chamber 16. The second lower spray assembly 32 is illustrated as including a vertically oriented distribution header or spray manifold 40. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 42 and a pump assembly 43. The sump 42 collects the liquid sprayed in the treating chamber 16 and can be formed by a sloped or recess portion of a bottom wall of the tub 14. The pump assembly 43 can include both a drain pump 44 and a recirculation pump 45. The drain pump 44 can draw liquid from the sump 42 and pump the liquid out of the dishwasher 10 to a household drain line (not shown). The recirculation pump 45 can draw liquid from the sump 42 and the liquid can be simultaneously or selectively pumped through a supply tube 46 to each of the assemblies 30, 32, 34, 36, 38 for selective spraying. While not shown, a liquid supply system can include a water supply conduit coupled with a household water supply for supplying water to the treating chamber 16.

A heating system including a heater 48 can be located within the sump 42 for heating the liquid contained in the sump 42.

A controller 50 can also be included in the dishwasher 10, which can be operably coupled with various components of the dishwasher 10 to implement a cycle of operation. The controller 50 can be located within the door 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
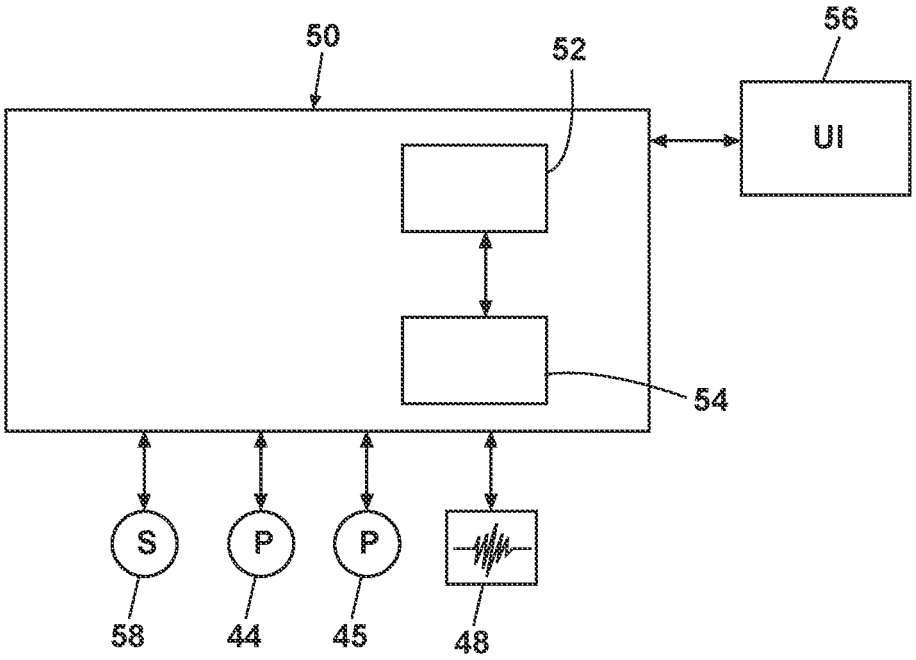
FIG. 2 is a schematic view of a controller of the dishwasher of FIG. 1.

As illustrated schematically in FIG. 2, the controller 50 can be coupled with the heater 48 for heating the wash liquid during a cycle of operation, the drain pump 44 for draining liquid from the treating chamber 16, and the recirculation pump 45 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step, or a combination thereof. These multiple steps can also be performed by the dishwasher 10 in any desired combination.

The controller 50 can also receive input from one or more sensors 58. Non-limiting examples of sensors that can be communicably coupled with the controller 50 include a temperature sensor and turbidity sensor to determine the soil load associated with a selected grouping of dishes, such as the dishes associated with a particular area of the treating chamber 16.

The dishwasher 10 can include all of the above exemplary systems, a selection of the above exemplary systems, and/or other systems not listed above as desired. Further, some of the systems can be combined with other systems and/or can share components with other systems. Examples of other systems that the dishwasher 10 can further include are a dispensing system that supplies one or more treating agents or chemistries to the treating chamber 16 and an air supply system that can provide air, which can be heated or not heated, to the treating chamber 16, such as for drying and/or cooling the dishes. An exemplary air supply system is set forth in U.S. patent application Ser. No. 12/959,673, filed Dec. 3, 2010, and published as U.S. Patent Application Publication No. 2012/0138106 on Jun. 7, 2012, both of which are incorporated herein by reference in their entireties.

The present disclosure relates to one or more dish racks having a low profile. Such dish racks often are configured to hold dishes in a more horizontal orientation compared to conventional dish rack configurations because the height of the low profile dish rack is not great enough to accommodate a cup in a vertical or near vertical orientation. In low profile dish racks, cups are oriented in a horizontal or near horizontal orientation. One way in which to quantify low profile dish racks is that the cups are supported in an orientation of 45 degrees or less relative to the horizontal, with most low profile dish racks supporting cups at a 30 degree or less relative to the horizontal.

In traditional dishwashers, dishes washed in a low-profile dish rack configuration often have residual liquid that can pool or puddle in or on the dish due to the increased horizontal orientation of the dish and the surface tension of the pooled liquid. This pooled liquid can negatively affect the drying performance of the dishwasher by increasing drying times. The pooling is problematic in dishes, especially cups, which have a lip, especially a rounded lip like that on a rim of a cup. In addition, as the pooled liquid dries, the pooled liquid will often leave behind a visible mark or "spot" on the dish. This disclosure addresses the pooling of the liquid by wicking away the pooled liquid before it dries. One way in which the wicking is accomplished is by breaking the surface tension of the pooled liquid and the cup with a structure contacting the pooled liquid and provide a surface along which the liquid can be wicked away from the cup. "Wicking" and its variants, as used in this description, is not limited to the traditional form of wicking, which is to flow through a material by capillary action. Wicking as used in this description also includes movement of liquid by surface tension, along with liquid flow by the Coanda effect where liquid naturally tends to stay attached to a surface.

Figure 3:
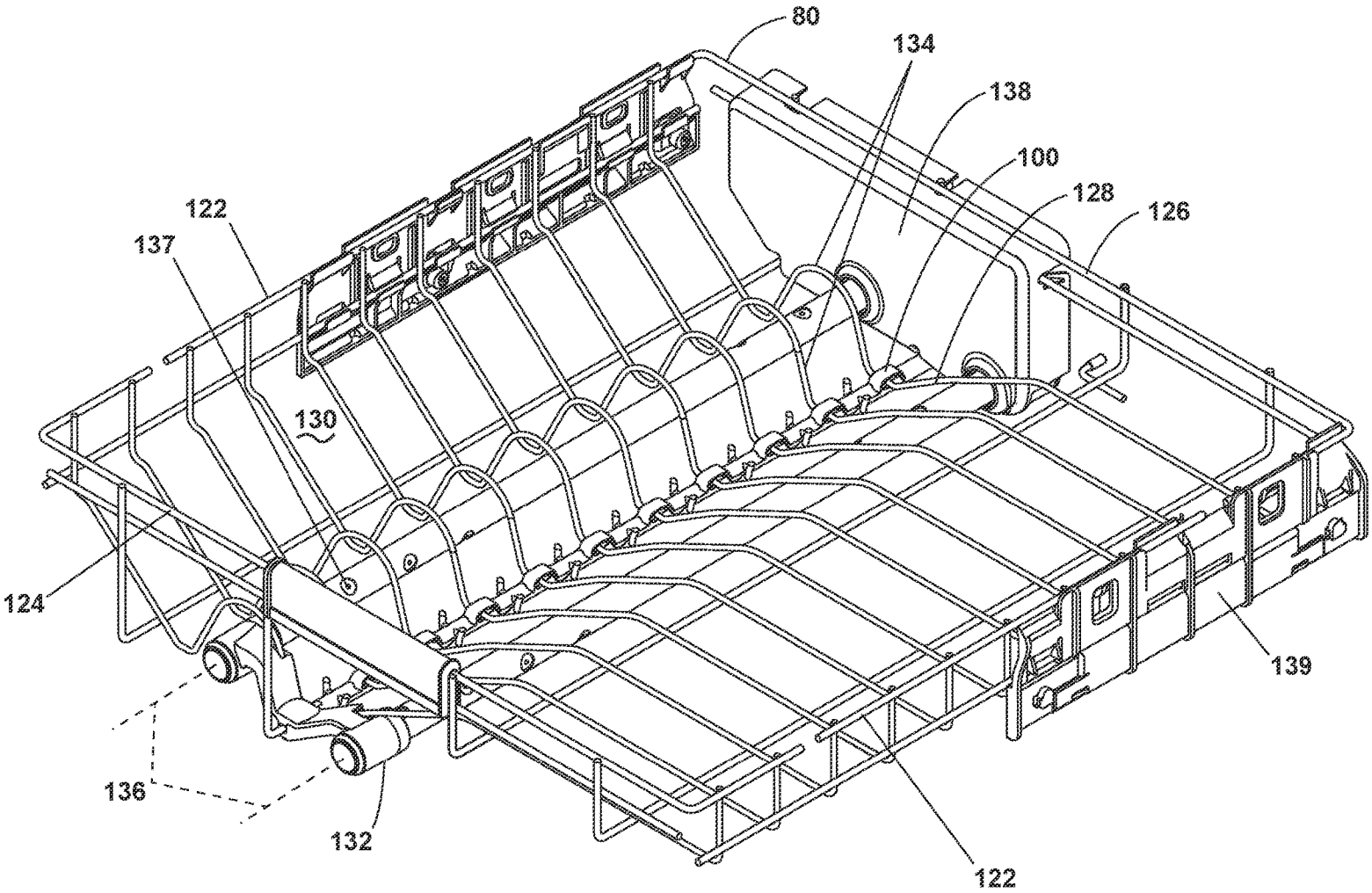
FIG. 3 is a perspective view of an upper dish rack with the wicking element of the dishwasher of FIG. 1.

FIG. 3 illustrates an exemplary low profile dish holder 80, ideally suitable for use as the upper dish rack 24, and has a wicking element 100 suitable to retard the pooling of liquid on dishes, especially cups, retained in the dish holder 80. While the dish holder 80 is a low profile dish holder suitable for use as an upper dish rack, it will be understood that that the dish holder 80 can be used in place of any of the dish racks 24, 26, 28 and that the wicking element 100 can be used in any of the dish racks 24, 26, 28. Thus, any description of the dish racks 24, 26, 28 is applicable to the dish holder 80.

The dish holder 80 can be constructed of a wire frame forming opposing side walls 122, front wall 124, rear wall 126, and a bottom wall 128 that together define an open-top holding compartment 130. A plurality of spaced wire frame elements 134 can define one or more dish supporting surfaces in the open-top holding compartment 130.

The dish holder 80 can be equipped with at least one sprayer 132 which is rotatable and adapted to provide treating liquid to dish items placed on the dish holder 80. Each of the at least one sprayers 132 can be selectively rotatable about an axis of rotation 136. The axis of rotation 136 can be parallel to the bottom wall 128. Alternatively, the at least one sprayer 132 can be stationary and each of the at least one sprayers 132 can be fixed to the dish holder 80, the tub 14, or a combination. A plurality of spray nozzles 137 that collectively form an outlet of the rotatable sprayer 132 can also be included along at least a portion of a length of the tube. The rotatable sprayers 132 have been illustrated in the form of a rod or tube sprayer, but it will be understood that the rotatable sprayers 132 can have any suitable cross-sectional shape, such as, by way of non-limiting example, circular, oval, hexagonal, trapezoidal, etc. The sprayers 132 can be fixedly mounted to and carried by the dish holder 80 and located below the bottom wall 128 configured for movement therewith when the dish holder 80 is slid relative to the tub 14, as illustrated, or alternatively, the sprayers 132 can be fixedly mounted to the tub 14 so as to retain position relative to the tub 14 when the dish holder 80 is slid relative to the tub 14. In the former case, the rotatable sprayers 132 can dock through a connector 138 with the supply tube 46 (FIG. 1) or other structure of the liquid supply and/or recirculation systems when the dish holder 80 is slid to its most rearward position in the tub 14 to establish fluid communication with the liquid supply and/or recirculation systems.

The dish holder 80 further includes one or more slides 139 configured to movably mount the dish holder 80 to the tub 14 such that the dish holder 80 can be slid in and out of the tub 14 when the door 18 is open.

The dish holder 80 can be equipped with at least one wicking element 100 mounted to the wire frame. The wicking element 100 is illustrated as mounted to the bottom wall 128 of the wire frame transverse to the wire frame elements 134 such that the wicking element 100 spans a length of the bottom wall 128 between the front wall 124 and the rear wall 126. Alternatively, however, the wicking element 100 can be mounted in any portion of the wire frame. The wicking element 100 can be removably or permanently affixed to the wire frame. Further, the wicking element 100 can be further fastened at one or both ends to the rear wall 126 and/or front wall 124 with any suitable fastener or fastening feature such as a tension-fit, snap-fit, catch, screw, or weld.

Figure 4:
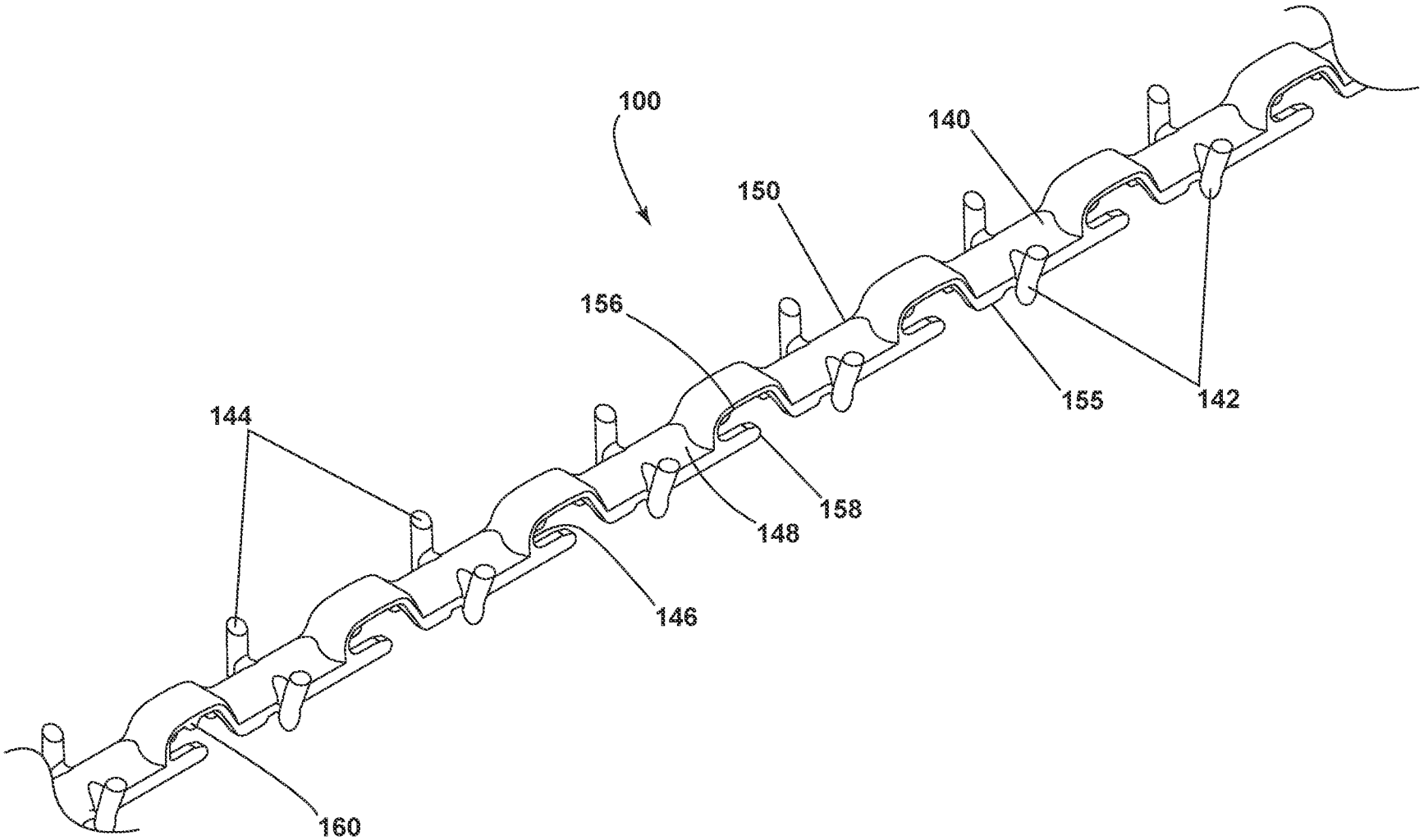
FIG. 4 is a perspective view of the wicking element of FIG. 3.

The physical details of the wicking element 100 are more easily seen in FIG. 4, which is a perspective view of the wicking element 100, removed from the dish holder 80. The wicking element 100 comprises a longitudinal body 140, one or more first and second wicks 142, 144 extending from the longitudinal body 140, and one or more slots 146 formed in the longitudinal body 140 each configured to receive at least one wire frame element 134. The longitudinal body 140 defines a length of the wicking element 100. The first wicks 142 are spaced apart and extend upwardly from a first side 148 of the longitudinal body 140. The second wicks 144 are spaced apart and extend upwardly from a second side 150 of the longitudinal body 140. Each of the first wicks 142 is opposite each of the second wicks 144.

Each of the slots 146 is spaced apart and formed along a bottom portion 155 of the longitudinal body 140 such that each slot 146 is separated by a pair of wicks comprised of one first wick 142 and one second wick 144. The one or more slots 146 can be C-shaped. Each C-shaped slot 146 can have a top portion 156 of the C-shape that is continuously formed with the longitudinal body 140 along the length, and a bottom member 158 of the C-shape at the bottom portion 155 of the longitudinal body 140. Each slot 146 can optionally include a catch feature, such as a bump 160.

Figure 5:
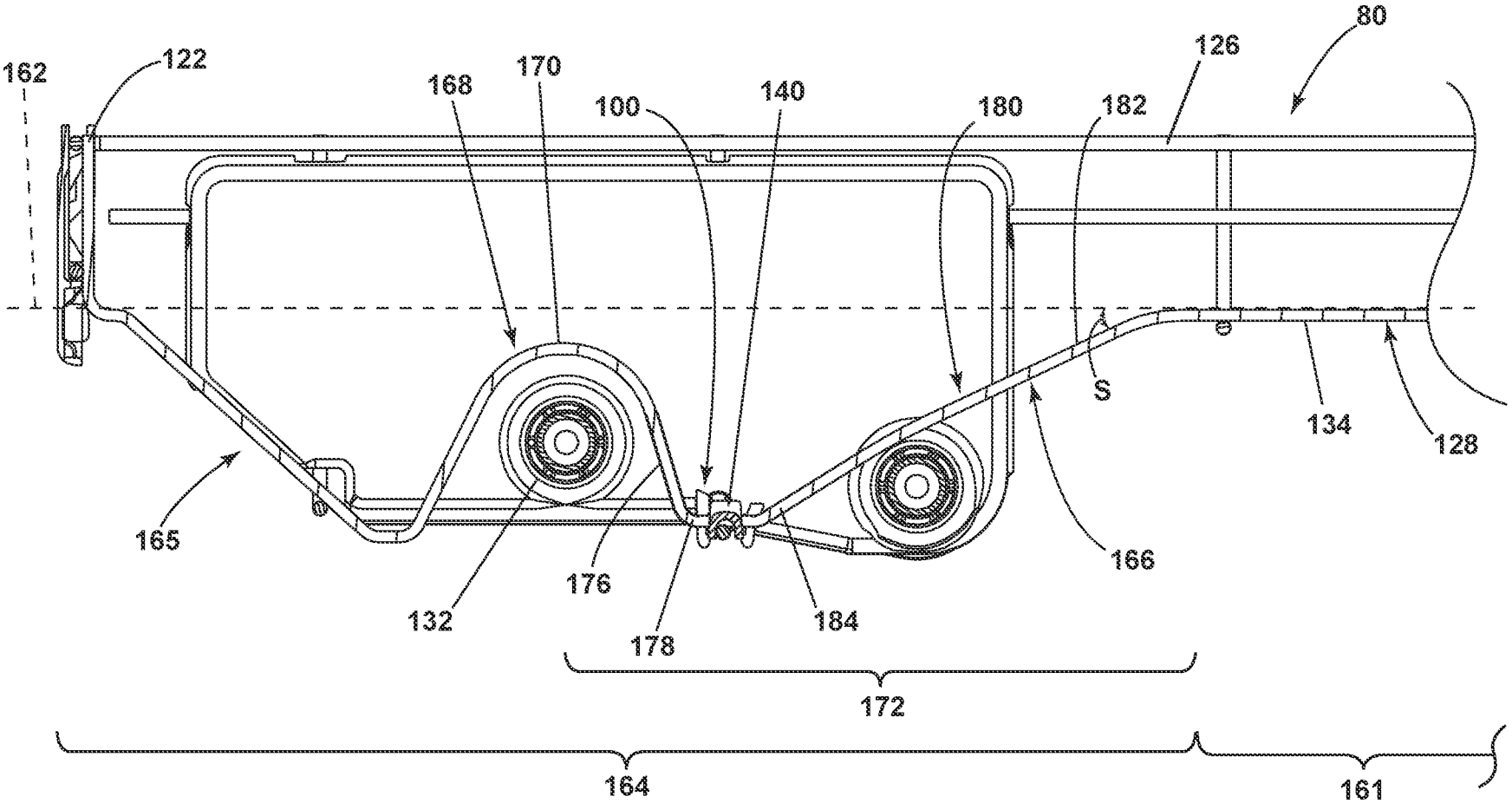
FIG. 5 is a front sectional view of a portion of the upper dish rack and wicking element of FIG. 3.

FIG. 5 illustrates a front view of the dish holder 80 and the wicking element 100. The bottom wall 128 can have a constant profile or can have a varied profile comprising any combination of inclined, curved, or flat sections or plurality of sections. The varying profile can be utilized to support various dishes as will be described in more detail below. Additionally or alternatively, a plurality of supports such as panels, tines, or other structures, can extend upwardly from the bottom wall 128 and/or the side walls 122, or the front and rear walls 124 (FIG. 3), 126 to support various dish items.

Portions of the dish holder 80 can be particularly configured to hold containers, drinking vessels, or other low profile items, such as, for example, tall and short tumblers, including old fashioned glasses and highballs, stemware, such as wine glasses, martini glasses, and tulip and saucer champagne glasses, snifters, goblets, bottles, mugs, bowls, containers, and the like, which are hereinafter referred to as "drinkware" with it being understood that "drinkware" includes those exemplary dishes listed above in addition to others not listed herein. The drinkware can be made of any suitable material, including glass, ceramics, plastic, and metals and are not limited to glass materials. Portions of the dish holder 80 can further be configured to hold silverware on its edge or support a silverware basket.

The dish holder 80 can include a silverware portion 161, with a flat bottom defining a virtual bottom plane 162 for the dish holder 80 and configured to support utensils, serving spoons, or optionally support a removable basket or tray, and a drinkware portion 164 comprised of a first and second sloped sections 165, 166 that each slope downwardly from the virtual bottom plane 162, toward a common ridge 168 having a peak 170, illustrated just below the virtual bottom plane 162, and configured to support drinkware. The connecting ridge 168 can provide a location for the sprayer 132 beneath the bottom wall 128, such that it can emit spray into the open tops of the drinkware. As illustrated, the vertical height of the drinkware portion 164 is greater than the height of the side walls 122 of the dish holder 80. Additionally, the height of the side walls 122 can be selected to be commensurate with a low profile utensil, such as a spoon or a spatula, placed on its side in the silverware portion 161.

The drinkware portion 164 comprises at least two spaced wire elements 134 defining one or more container supports 172. The container support 172 is formed by the second sloped section 166 and a ridge arm 176 of the connecting ridge 168 joined to the second sloped section 166 by a connecting portion 178. The second sloped section 166 and the ridge arm 176 can each be provided at an angle sloped downward from the virtual bottom plane 162 such that the effective width of the container support 172 is greater than the height of the side walls 122 of the dish holder 80. The second sloped section 166 and the connecting portion 178 form a support surface 180 having generally referenced upper end 182 and a lower end 184. The support surface 180 defines a slope S of less than 30 degrees relative to a horizontal reference such as the virtual bottom plane 162. Alternatively, the support surface 180 can define any slope such that the effective width of the support surface 180 is greater than the height of the side walls 122 of the dish holder 80.

Figure 6:
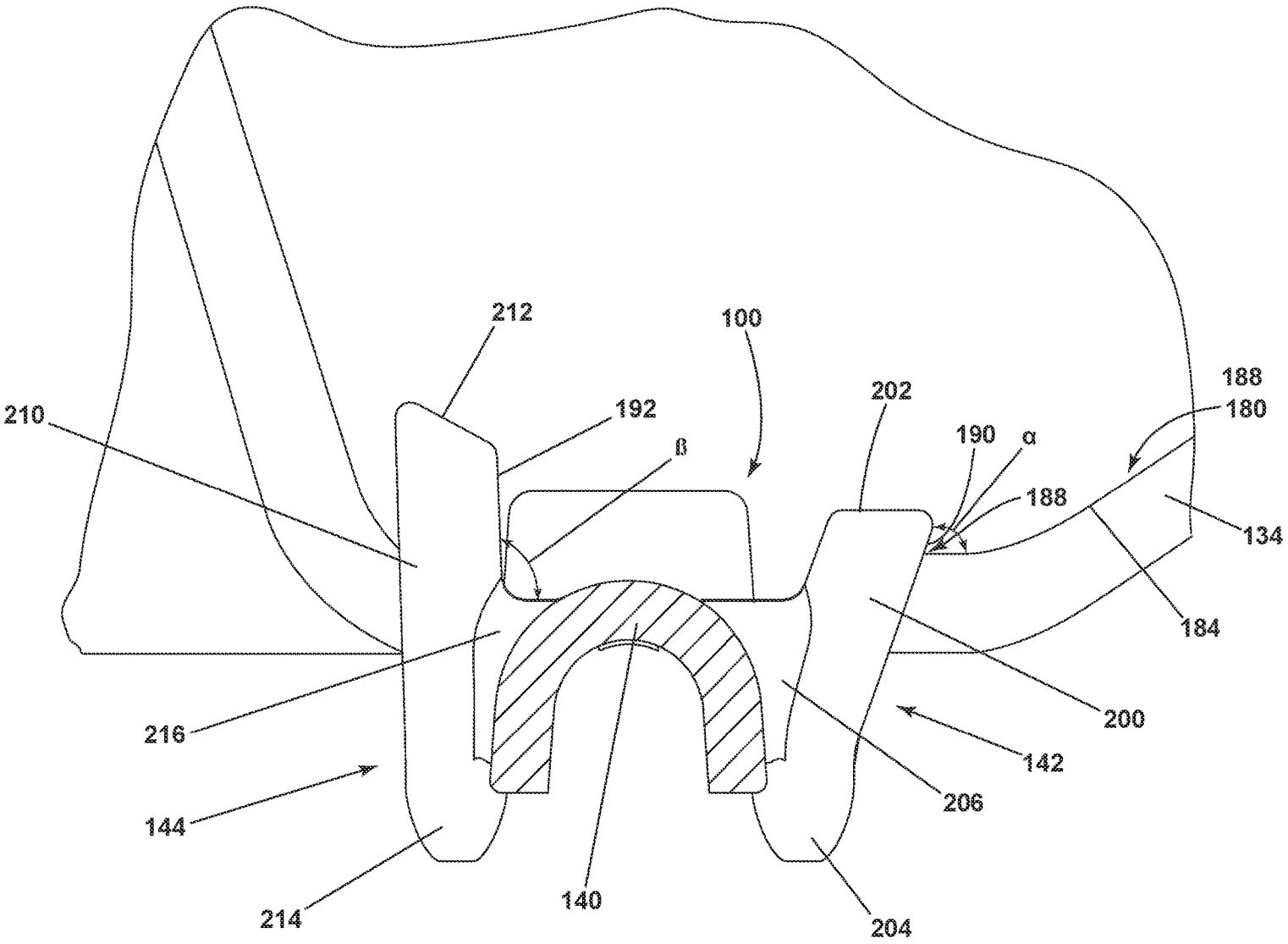
FIG. 6 is an enlarged view of a portion of FIG. 5.

FIG. 6 is an enlarged sectional front view of a portion of the dish holder 80 and the wicking element 100. The wicking element 100 is mounted at the lower end 184 of the support surface 180 at the connecting portion 178. The wicking element 100 is mounted such that at least a portion of the wicking element 100 is partially overlying at least a portion of the support surface 180 to define a seat 188 at the lower end 184.

The first and second wicks 142, 144 extend from the longitudinal body 140 of the wicking element 100 to each define a stop, or position, at the lower end 184 of the support surface 180. The first wick 142 forms a first stop 190 at the lower end 184 of the support surface 180 at the seat 188. The second wick 144 forms a second stop 192, spaced down slope from the first stop 190 and having a height greater than the height of the first stop 190.

The first wick 142 includes an upper portion 200 with a top 202 that can be flat or angled, and a lobed lower portion 204 that depends below the longitudinal body 140. The upper portion 200 is angled away from the longitudinal body 140 at a connecting body 206 such that a portion of the upper portion 200 defines the first stop 190 and forms an acute first angle α with the sloped support surface 180 in the seat 188 relative to the virtual bottom plane 162. The first angle α can be any acute angle. In aspects of the present disclosure, the first angle α is between or equal to 70 and 80 degrees.

The second wick 144 includes an upper portion 210 with a top 212 that can be angled or flat, and a lobed lower portion 204 that depends below the longitudinal body 140. The upper portion 210 is generally vertical and a portion of the upper portion 210 defines the second stop 192 and forms a second angle β with the longitudinal body 140 at a connecting body 216, greater than the first angle α, relative to the virtual bottom plane 162. In aspects of the present disclosure, the second angle β is approximately 90 degrees.

While illustrated with two stops, it is within the scope of the invention for there to be a single stop or more than two. The illustrated two stops with different angles provides greater flexibility than a single stop.

Figure 7:
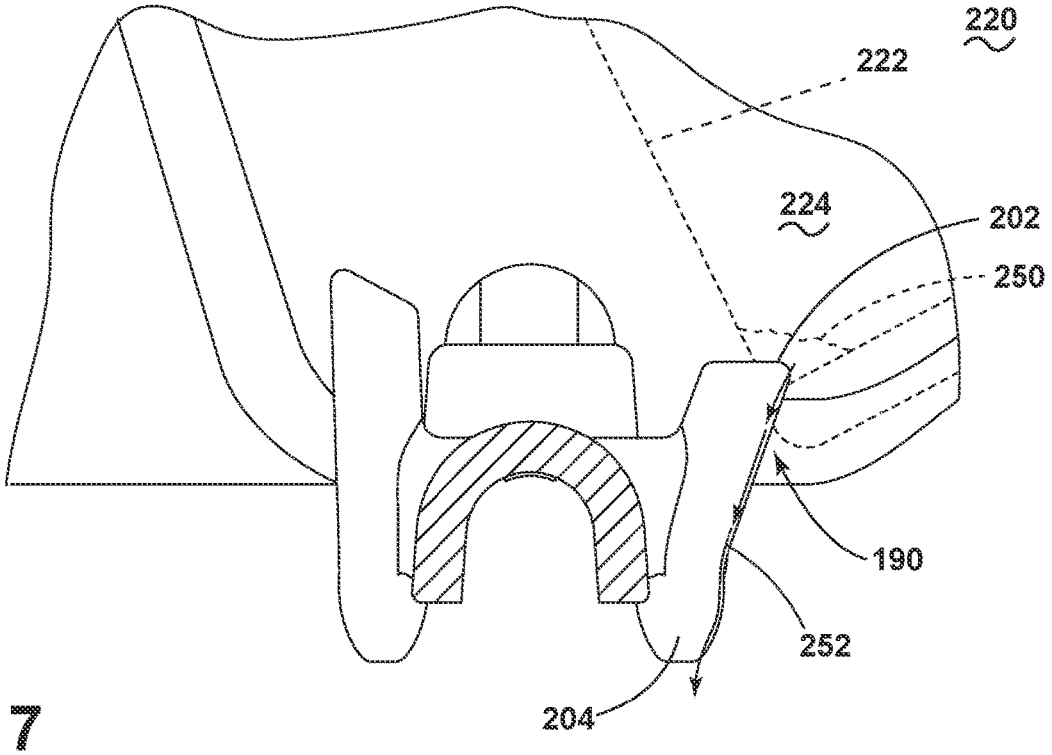
FIG. 7 is an enlarged view of a portion of FIG. 5 illustrating a cup in a first drying position relative to the wicking element.

FIG. 7 illustrates a first drying position 220 of the wicking element 100. In the first drying position 220, a lip edge 222 of a drinkware item 224 engages the seat 188 at the first stop 190. The top 202 of the first wick 142 projects into the drinkware item 224 and is configured to break the surface tension of a liquid 250 that pools at the lip edge 222 such that the liquid 250 will wick away from the drinkware item 224 in the direction of arrows 252 and down the first wick 142 to pool and drip away from the wicking element 100 at the lobed lower portion 204.

Figure 8:
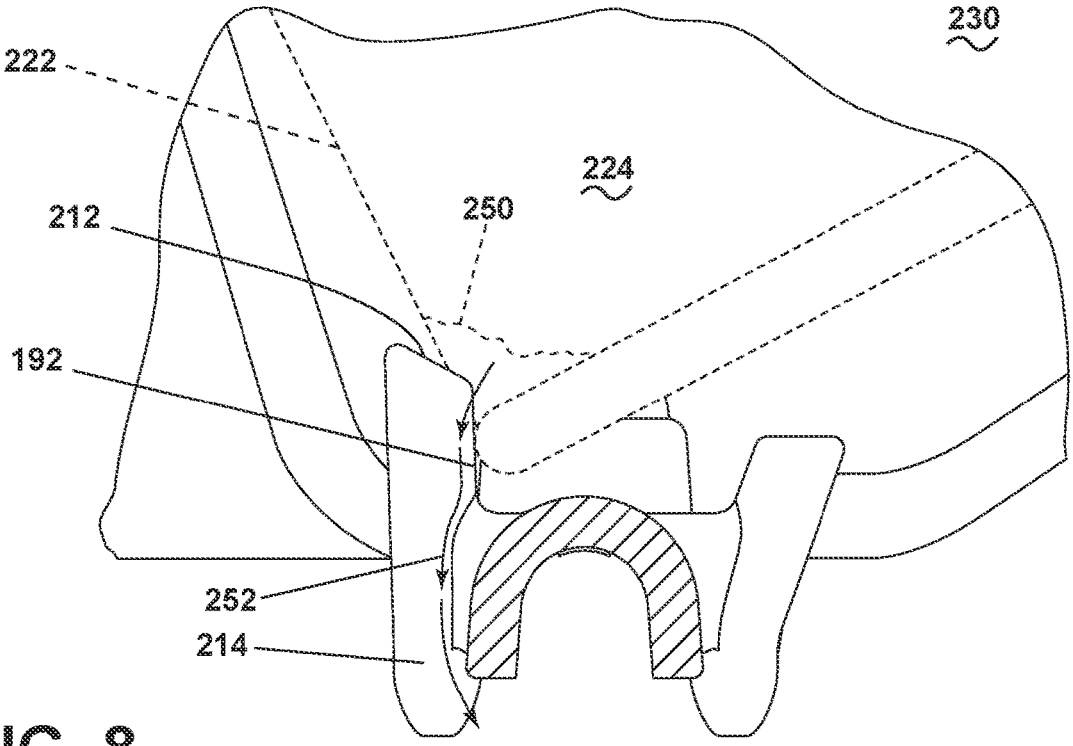
FIG. 8 is an enlarged view of a portion of FIG. 5 illustrating a cup in a second drying position.

FIG. 8 illustrates a second drying position 230 of the wicking element 100. Similar to the first drying position 220, in the second drying position 230, the lip edge 222 of the drinkware item 224 engages the second stop 192. The top 212 of the second wick 144 projects into the drinkware item 224 and is configured to break the surface tension the liquid 250 that pools at the lip edge 222 such that the liquid 250 will wick away in the direction of arrows 252 from the drinkware item 224 and down the second wick 144 to pool and drip away from the wicking element 100 at the lobed lower portion 214.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish holder for a dishwasher comprising:

a wire frame racking having a plurality of spaced wire frame elements, with adjacent wire frame elements forming sloped support surface, having a lower end and an upper end, with a seat at the lower end; and a wicking element mounted to the wire frame at the lower end, the wicking element comprising a longitudinal body overlying a portion of the lower end and first and second wicks extending from and fixedly mounted to opposite side of the longitudinal body, and having at least one wick fixed relative to the wire frame and forming an acute angle to a horizontal reference and overlying at least a portion of the support surface to define a seat for engaging a lip edge of glassware such that a first stop of the first wick abuts the lip edge to break a surface tension of a liquid in the glassware and wherein a top of the first stop extends into the glassware when the first wick abuts the lip edge of the glassware.

2. The dish holder of claim 1 wherein the acute angle is between 70 and 80 degrees.

3. The dish holder of claim 1 wherein the second wick has a height greater than the first wick.

4. The dish holder of claim 3 wherein the first and second wicks correspondingly define first and second angles relative to the horizontal reference, with the second angle being greater than the first angle.

5. The dish holder of claim 1 wherein the dish holder is a low profile dish holder.

6. The dish holder of claim 5 wherein the support surface has an effective width and the dish holder has a height less than or equal to the effective width.

7. The dish holder of claim 1 wherein the wicking element comprises at least one slot receiving at least one of the spaced wire frame elements.

8. The dish holder of claim 7 wherein the wicking element has a longitudinal body defining a body axis that is transverse to the wire frame elements.

9. A dish holder comprising a support surface having a lower end and an upper end for a dishwasher comprising:

a wicking element located at the lower end and comprising a longitudinal body overlying a portion of the lower end and first and second wicks extending from and fixedly mounted to opposite side of the longitudinal body, wherein the first wick overlays a portion of the support surface to define a seat for engaging a lip edge of glassware such that a first stop of the first wick abuts the lip edge to break a surface tension of a liquid in the glassware and wherein the second wick has a second stop, spaced down slope from the first stop and the second stop has a height greater than the first stop.

10. The dish holder of claim 9 wherein the support surface defines a slope of less than 30 degrees relative to a horizontal reference.

11. The dish holder of claim 9 wherein a top of the first stop extends into the glassware when the first wick abuts the lip edge of the glassware.

12. The dish holder of claim 9 wherein the first and second stops correspondingly define first and second angles relative to the horizontal reference, with the second angle being greater than the first angle.

13. The dish holder of claim 12 wherein the dish holder comprises a wire frame rack and the longitudinal body of the wicking element is mounted to the wire frame rack.

14. The dish holder of claim 13 wherein the wire frame rack comprises at least two spaced wire frame elements forming the support surface.

15. The dish holder of claim 14 wherein the wicking element is mounted to at least one of the two spaced wire frame elements.

* * * * *